United States Patent [19]

Rosenfeld

[11] 4,059,117

[45] Nov. 22, 1977

[54] GIRDLE ACCESSORY

[76] Inventor: Pnina Rosenfeld, 7635 W. Hampton Ave., Los Angeles, Calif. 90046

[21] Appl. No.: 699,033

[22] Filed: June 23, 1976

[51] Int. Cl.[2] ..... A41C 1/00

[52] U.S. Cl. ..... 128/531

[58] Field of Search ..... 128/531, 532, 518 R; 2/406, 312, 304, 302, 319, 320, 313

[56] References Cited

U.S. PATENT DOCUMENTS

| | | | |
|---|---|---|---|
| 2,717,437 | 9/1955 | De Mestral | 24/204 |
| 2,891,545 | 6/1959 | Teague | 2/406 |
| 3,339,208 | 9/1967 | Marbach | 2/406 |

*Primary Examiner*—Werner H. Schroeder
*Assistant Examiner*—Doris L. Troutman
*Attorney, Agent, or Firm*—Erik M. Arnhem

[57] ABSTRACT

A band system or combination of bands for and useable in connection with a girdle, or the like, comprising two parts, one part of which forms an endless or closable circular belt means for horizontal placement around the waist region of the girdle, the other part thereof branching off a first sector on said belt means, at a relatively broad and uniform width, perpendicularly downward the center front section of the girdle, said width is decreasing just prior to reaching the crotch of the girdle to a relative narrower width, continuing substantially uniform at said narrow width, down under the crotch and then upwardly along the center back section of the girdle, and terminating at a second sector of said belt means, being located substantially diametrically opposite said first sector of the belt means.

3 Claims, 5 Drawing Figures

GIRDLE ACCESSORY

SUMMARY OF THE INVENTION:

The invention relates to an accessory to a girdle, or similar type undergarment, extending from or about the waist to below the hip, consisting of a band system or combination of bands or straps, designed to be interchangeably used over and together with a girdle; while the general purpose of the girdle is to firm up or control a part of the feminine figure, that is to say, to visually eliminate unseeming bulges, etc., appearing on portions of the body covered by the girdle, the latter when worn, however, also imparts, in particular to the back of the body, a straight shapeless and unnatural look, which runs counter to the modern trend of revealing the natural curves and partition of the lower part of the back of the female figure, i.e., the buttocks. With a view to retaining the natural configuration of the buttocks, i.e., the female anatomy of rounded prominences, seperated by a median cleft, while wearing a girdle, I have invented a especially constituted band or system of bands, preferably made — partly or wholly — of resilient material and more particularly, consisting of an endless or closable band forming a belt, to be worn below the abdomen or around the waist of the girdle and its user and a extension of the belt band branching off vertically from any location on its circumference, first vertically downward the center front section of the girdle by a length corresponding approximately to the distance between the waist and the crotch of the wearer, at a relatively broad width which just prior to reaching the crotch is decreasing to a relative narrower but uniform width, said downwardly extending band is then turning under the crotch and upward along the center back of the girdle terminating at a location on the belt, situated diametrically opposite the starting location of the said vertical band extension thus forming sort of a loop suspended from the belt portion proper.

The belt and its suspended loop portion may be made, as described above, integrally with one another, i.e., forming a solid one piece unit, or be wholly or partly, detachable from one another. The wearer of a girdle, who wishes to eliminate the drawbacks associated with the latter, as described above, may, if the device, according to the invention, is made of one integral piece, simply "step into " same, placing the belt portion about the waist over the girdle, so as to cause the loop portion of the band device to extend, substantially in alignment with the navel of the wearer, vertically downward, passing under the crotch and then upwardly, centering between the two rounded prominences of the buttocks, thus pressing inwardly the natural cleft separating the latter, and thereby restoring the natural curved look of the lower back portion of the wearer.

The belt portion of the device may also be made openable and closable by means of a buckle, hood-and-fastener, or the like, and the loop portion for same may partly or wholly, be made separable from and attachable to the belt portion, e.g., by means of buttons, "velcro" loop-and hook type attachments, etc.; the latter embodiment may particularly be desirable if the wearer wishes to adjust the length of the loop portion of the device to assure sufficient by comfortable pressure on the buttocks. Thus, one end of said loop portion of the device may be connected integrally onto one point of the belt, while the other end is easily attachable to and detachable from a diametrically located point on the belt (by any suitable closing means, as indicated above) and forming the loop portion therewith; or the belt and loop portions, respectively, may come in two completely seperated parts for subsequent attachment to one another, according to the invention. If the latter embodiments of the invention are preferable, then the user may simply gird the belt portion, and then sbsequently attach the loop extension of the belt thereto, as described above.

BACKGROUND OF THE INVENTION:

The applicant calls attention to the following prior U.S. Pat. Nos: BENISH; 1,672,296 June 5, 1928; TEAGUE;2,891,545; June 23, 1959;HANKEN; 2,962,026; NOV. 10, 1960.

The purposes and constructions of BENISH and TEAGUE above differ completely from those of applicant's invention. Hanken discloses a complete girdle with elaborate non-resilient adaptations to accentuate the natural shape or curves of the feminine body which are only usable in conjunction with stockings. Applicant's invention, contrary to that of HANKEN'S, provides for a much simplier "self contained" device, which may be used interchangeably and comfortably with any undergarment.

DESCRIPTION OF THE INVENTION:

In addition to (e) above, it is the primary object of this invention to provide a simple, comfortable and inexpensive accessory useable in connection with, and externally attached, to a worn girdle, in order to eliminate the unnatural and flat look imparted to the figure of the girdle wearer.

It is a further object of the invention to provide means for resiliently or manually adjusting the belt-and-loop device, according to the invention, to the individual dimensions and requirements of wearer, so as to completely attain the purposes of the invented girdle accessory.

The invention also comprises novel details of constructions and combinations, which will more fully appear in the course of the following description, being based on the accompanying drawings. However, said drawings merely show, and the following description merely describes preferred embodiments of the present invention, which are given by way of illustration or examples only.

DESCRIPTION OF THE DRAWINGS

In the drawings, like reference characters designate similar parts in the several views.

Figure 1:
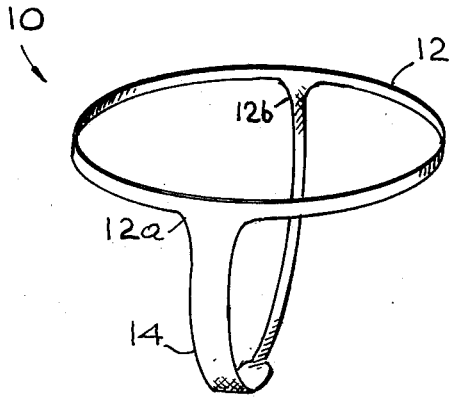
FIG. 1 is a perspective view of the girdle accessory, consisting of an endless belt and loop portion.

FIG. **4*a* and 4*b***, respectively, are perspective views of the front and back portions of a girdle, with the invented accessory surmounted thereon.

DETAILED DESCRIPTION OF THE DRAWING

Referring now in detail to the drawing, the complete girdle accessory is indicated by numeral 10. According to FIG. 1, the girdle attachment is made of one integral unit, namely a belt portion 12, placeable about the waist of the wearer, and a loop portion 14, branching off at diametrically oppositely located points on belt portion 12. The device, as illustrated in FIG. 1, may be donned by simply "stepping into" it. The band system is preferably but not necessarily, made, in part, or entirely, of resilient material so as to make it expansible to fit the varying sizes of its users. The widening merging areas of the belt and loop portions,12*ab* are provided to increase the support surface and wearing comfort of the accessory 10, vis-a-vis the underlying girdle.

Figure 4A:
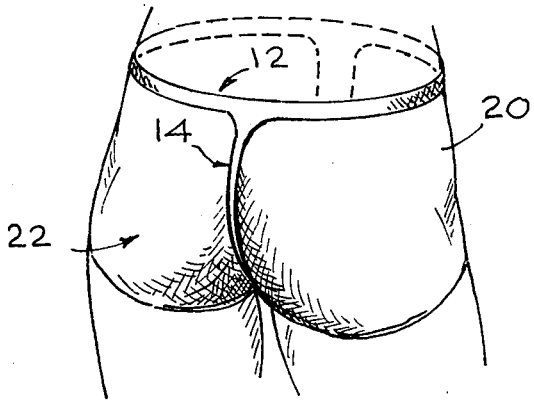

The loop portion 14 extends initially from one sector 12*a* of the belt portion 12, downwardly along the center front portion of the girdle (FIG. 4*b*) at a relatively broad width which decreases just prior to reaching the girdle crotch to a relative narrower width and then continuing substantially uniform at said narrow width, down under the crotch and then upwardly along the center back section of the girdle, and terminating at a sector 12*b* of the belt means, being located substantially diametrically opposite said first sector thereof. The wearer will, when putting the invented accessory over the girdle, apply the wide part of the loop 14 to the center front section of the girdle (FIG. 4*b*), while the narrower part thereof will coincide with the buttocks dividing line and crotch of the wearer (FIG. 4*a*). The wider portion of the loop 14 will constitute a comfortable supportive surface along the front section of the girdle, while the narrower portion of the loop 14, due to its narrow configuration, will apply fittingly between the buttocks of the wearer.

Figure 2:
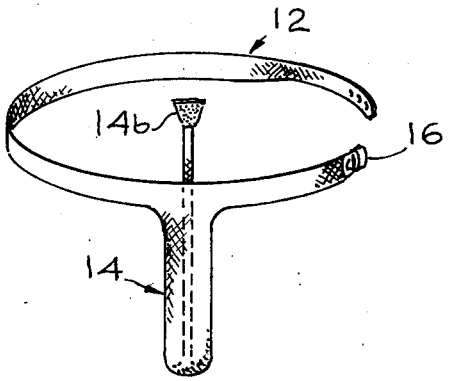
FIG. 2 is a perspective view of another embodiment of the invention showing the accessory with a closable belt and loop portions, respectively.

FIG. 2 is a second embodiment of the invention, where the belt portion 12 is provided, with an openable and closable means, such as a belt buckle 16 preferably mounted laterally to the fastening sectors between loop and belt portions. One of the ends 14*b* of the loop 14 is detached from the belt 12, and may be attached to the latter by any appropriate closing means, e.g., superposing an adjustable "velcro" layer on the same 14*b*, and on the corresponding closing part of the belt. The loop portion 12 should, suitably, measure about 2 inches at its broadest width, and approximately a ½ inch at its narrower cross section, to insure comfortable and effective fitting onto the body of the wearer.

Figure 3:
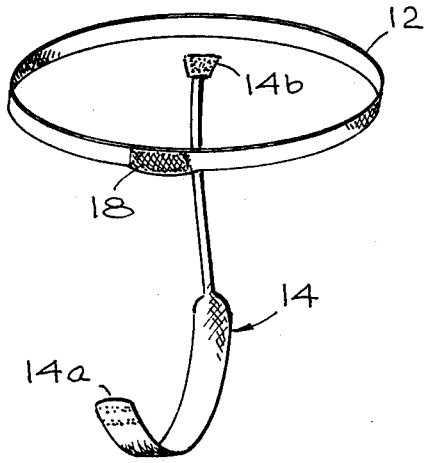
FIG 3 is a perspective view of still another version of the invented accessory, consisting of the belt and loop portions, which are completely seperable from one another.

FIG. 3 illustrates a third embodiment of the invention, where the belt and loop portions 12 and 14, respectively, are completely detachable from one another, as indicated by the two loose ends of the loop portions, 14*a* and 14*b*. The two latter may be attached to the belt 12 by any suitable closing means, e.g. those stated with regard to the embodiment of FIG. 2. The very end 14*b* of the narrow portion of the detachable loop 14 is somewhat broadened, in order to also enlarge its adhesive or supporting area vis-a-vis the belt portion 12, being particularly suitable where the closing means 18 between belt and loop ends 14*a*, 14*b* consist of "velcro" loops-and-hooks.

Figure 4B:
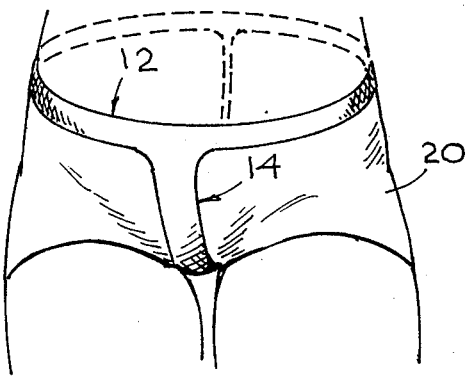

Finally, FIGS. 4*a* and 4*b*, respectively, illustrate the front and back positions of the invented attachment device in conjunction with the use of girdle 20. FIG. 4*a* indicates the position of the narrow loop portion 14, extending from the belt and encroaching on and thus accentuating, the cleft of the buttocks 22. FIG. 4*b* shows the wider loop portion coming from about the crotch of the wearer and continuing up front the girdle 20 where it merges below the abdomen of the wearer in the belt portion 12.

While the foregoing has illustrated and described what is now contemplated to be the best mode of carrying out the invention, the construction is, of course, subject to modifications without departing from the spirit and scope of the invention. Therefore, it is not desired to restrict the invention to the particular forms of construction illustrated and described, but to cover all modifications that may fall within the scope of the appended claims.

I claim:

1. In an accessory for and placeable over a girdle, or the like, comprising a. a first band length encompassing the girdle horizontally, b. a second band length branching off a first sector on the first band length, extending vertically downward therefrom substantially along the center front of the girdle at a relatively broad uniform width, decreasingjust prior to reaching the crotch of the girdle to a narrower width passing at said narrower width under the crotch, then vertically upward along the center back of the girdle and terminating at a second sector, located diametrically opposite said first sector on the first band length, so as to form a loop therewith.

2. An accessory for a girdle, according to claim 1, in which the merging areas of the first and second band lengths are widened.

3. In an improvement for a girdle, comprising in combination a. a girdle b. a first length of band, encompassing the girdle horizontally c. a second length of band branching off a first sector on the first band length, extending vertically downward therefrom substantially along the center front of the girdle, at a relatively broad width, decreasing just prior to reaching the crotch of the girdle to a narrower width, passing at said narrow width under the crotch, then vertically upward along and terminating at a second sector, located diametrically opposite said first sector on the first band length to form a loop therewith.

* * * * *